US007772825B2

(12) United States Patent
Shieh

(10) Patent No.: US 7,772,825 B2
(45) Date of Patent: Aug. 10, 2010

(54) CURRENT SOURCE PROVIDING LARGE SUPPLY CURRENT

(75) Inventor: Ching-Chih Shieh, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 396 days.

(21) Appl. No.: 11/819,438

(22) Filed: Jun. 27, 2007

(65) Prior Publication Data

US 2008/0042629 A1 Feb. 21, 2008

(30) Foreign Application Priority Data

Jun. 30, 2006 (TW) ..... 95123758 A

(51) Int. Cl.
*G05F 3/08* (2006.01)

(52) U.S. Cl. ..... 323/312

(58) Field of Classification Search ..... 323/312, 323/315

See application file for complete search history.

(56) References Cited

U.S. PATENT DOCUMENTS 7,576,574 B2 * 8/2009 Noda ..... 327/108
2005/0104574 A1 * 5/2005 Hoon et al. ..... 323/315
2008/0042629 A1 * 2/2008 Shieh ..... 323/281
2008/0224632 A1 * 9/2008 Noda ..... 315/291
2009/0261894 A1 * 10/2009 Zhou et al. ..... 327/537

* cited by examiner

*Primary Examiner*—Jeffrey L Sterrett

(57) ABSTRACT

A current source comprises a current driver comprising a current generator and a first resistor serially coupled at a first node, a level shift unit located between the first node and a second node to generate a rated voltage difference between the second and the first nodes, and a voltage regulator device having an input terminal coupled to the second node and an output terminal coupled to a control terminal of the current generator. The voltage regulator device maintains the voltage level of the second node at a first voltage reference by modifying the voltage level of the control terminal. Along with the variation of the voltage level of the control terminal, a supply current generated by the current source for a load is varied to modify the voltage level of the second node to the first voltage level. The control loop stabilizes the supply current value.

17 Claims, 7 Drawing Sheets

CURRENT SOURCE PROVIDING LARGE SUPPLY CURRENT

BACKGROUND OF THE INVENTION

1. Field of the Invention

The invention relates to current sources and more particularly to controllable large current sources supplying large current to high power electronic devices.

2. Description of the Related Art

FIG. 1 shows a conventional current source 100, which generates a constant supply current $I_o$. The conventional current source 100 comprises a TLV431 regulator 102 and a transistor 104 operating as a current generator. The TLV431 regulator 102 maintains the voltage value of node 106 at a first voltage level $V_{ref}$. A constant current $I_1$ flows through a first resistor $R_1$, wherein $I_1=V_{ref}/R_1$. In transistor 104, the emitter current approximates the collector current. A reference input terminal of the TLV431 regulator 102 is coupled to node 106 and has high input impedance. The supply current $I_o$, therefore, approximates the constant current $I_1(I_o \approx I_1)$. If the supply current $I_o$ deviates from the constant current $I_1$ (wherein $I_1=V_{ref}/R_1$), the voltage level of node 106 deviates correspondingly from the first voltage level $V_{ref}$. The voltage deviation is detected and adjusted by the TLV431 regulator 102. As shown in FIG. 1, node 110 is connected to a control terminal of the current generator implemented by the transistor 104. The control terminal is the base terminal of the transistor 104. The supply current $I_o$ is determined by the voltage value of the control terminal 110. Along with the variation in the supply current $I_o$, the voltage value of node 106 can be adjustable. The TLV431 regulator 102 adjusts the voltage level of the control terminal 110 and adjusts the base current of the transistor 104 to control the supply current $I_o$ to maintain the voltage value of node 106 at the first voltage value $V_{ref}$, and therefore the supply current $I_o$ can maintain at the constant value $V_{ref}/R_1$.

With the conventional current source 100, however, the supply current $I_o$ is insufficient for high power electronic devices. For example, when the first voltage level ($V_{ref}$) of the TLV431 regulator 102 is 1.24V, the first resistor $R_1$ is set to 1.24 Ohm to generate a supply current $I_o$ of 1 Amp for a load 108. The power consumption of the first resistor $R_1$ is 1.24 W (evaluated from $P=I\cdot V=1\ A\cdot 1.24V=1.24\ W$). Currently, 1.24 W is considerably large for a chip. In general, the conventional current source 100 is designed to generate a supply current less than 500 mA. A current source generates large supply current for high power electronic devices such as direct current motors, power LEDs, or energy generators and others is thus called for.

BRIEF SUMMARY OF THE INVENTION

Novel current sources are provided to generate large supply current. The magnitude of the supply current is controllable and the supply current can be set as a pulse wave.

An exemplary embodiment of a current source comprises a current driver, a level shift unit and a voltage regulator device. The current driver comprises a current generator and a first resistor which are coupled in series via a first node. The current generator comprises a control terminal, and generates a supply current for a load. The first node is coupled to a second node via the level shift unit. The level shift unit generates a rated voltage difference between the first and the second nodes. The input terminal and the output terminal of the voltage regulator device are coupled to the second node and the control terminal, respectively. The voltage level of the control terminal of the current generator is adjusted by the voltage regulator device to maintain the voltage level of the second node at a first voltage level.

The level shift unit comprises a constant current source and a second resistor. The second resistor is coupled between the first and the second nodes. The constant current from the constant current source flows through the second resistor and generates a constant voltage across the second resistor. The voltage regulator device may be implemented by a voltage regulator chip having an input terminal and a cathode terminal respectively coupled to the second node and the control terminal. In another exemplary embodiment, the level shift unit further comprises a third resistor and a variable voltage source. The third resistor is coupled between the output terminal of the variable voltage source and the second node. The rated voltage difference between the first and the second nodes varies with the output voltage level of the variable voltage source. The supply current decreases with increasing output voltage of the variable voltage source.

In another exemplary embodiment, the level shift unit comprises a second resistor, a third resistor, and a variable voltage source. The first node is coupled to the second node via the second resistor. The third resistor is coupled between the output terminal of the variable voltage source and the second node. A rated voltage difference, generated by the level shift unit, is maintained between the first and the second nodes. The rated voltage difference varies with the output voltage level of the variable voltage source. The supply current decreases with increasing output voltage of the variable voltage source.

In another exemplary embodiment, the current source further comprises a current source switch coupled to the control terminal. The current source switch can shut down the current source by coupling the control terminal to a second voltage level. If the current source switch shuts down the current source intermittently, the supply current is a pulse wave. The current source switch comprises a pulse voltage source and a switch. When the output of the pulse voltage source is at a first level, the control terminal is coupled to the second voltage level by the switch, and the current source is shut down. When the output of the pulse voltage source is at a second level, the switch ceases coupling the control terminal to the second voltage level, the current source generates the supply current normally. The switch comprises a fourth resistor, a fifth resistor and a transistor. The fourth resistor is coupled between the output terminal of the pulse voltage source and the base of the transistor. The fifth resistor is coupled between the base and the emitter of the transistor. The collector and the emitter of the transistor are coupled to the control terminal and the second voltage level, respectively.

In another exemplary embodiment, the current source further comprises a diode and a sixth resistor. The anode and the cathode of the diode are coupled to the output of the voltage regulator device and the control terminal, respectively. The cathode of the diode is coupled to ground via the sixth resistor. The diode ensures the voltage level of the output of the regulator is in a correct region.

In another exemplary embodiment, the current generator of the current driver may be a transistor or a Darlington circuit.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
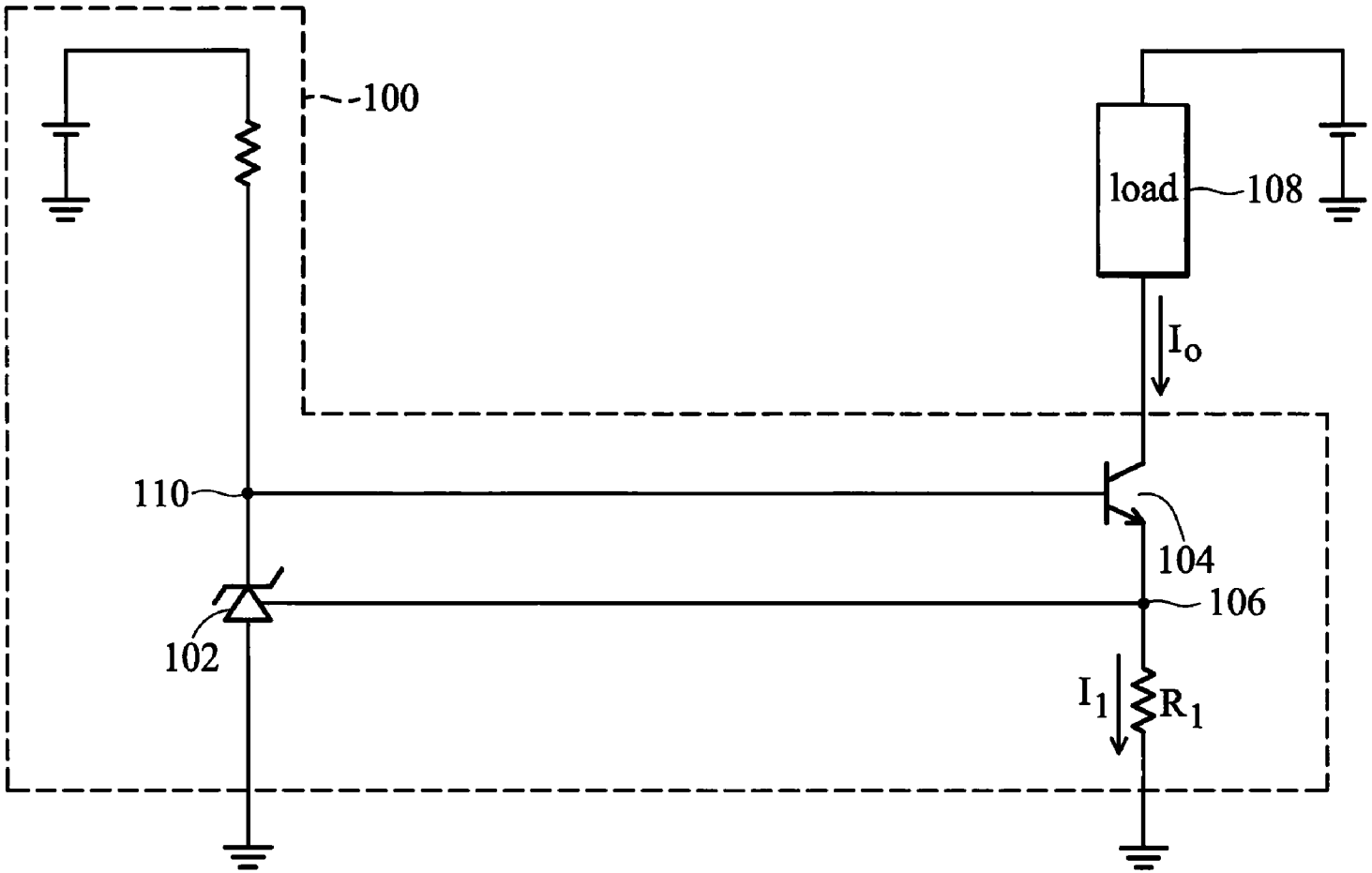
FIG. 1 ( PRIOR ART )
FIG. 1 shows a conventional current source.
Figure 2:
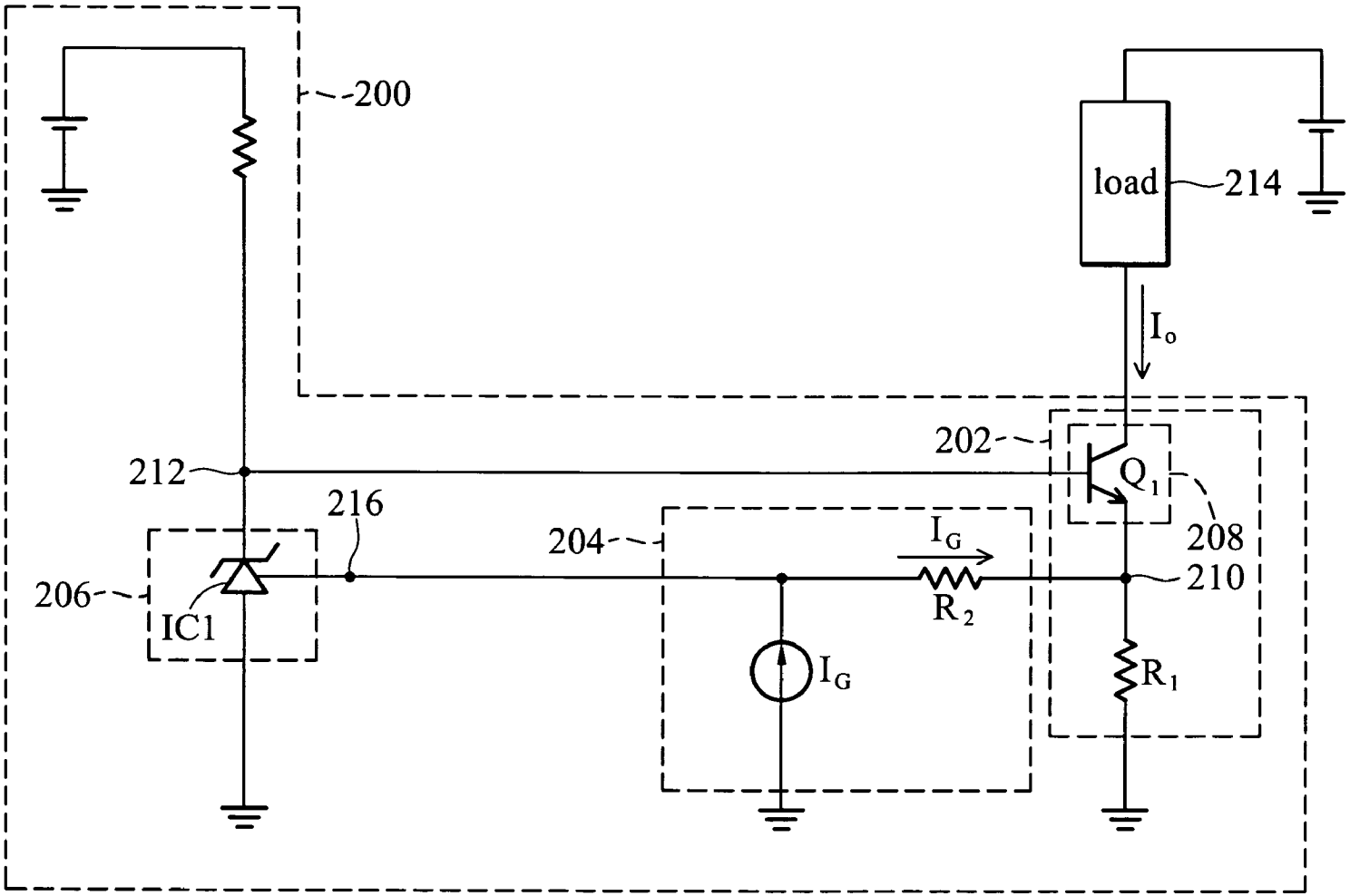
FIG. 2 shows an embodiment of the invention.

FIG. 2 shows an embodiment of the invention. The current source 200 comprises a first node 210, a second node 216, a current driver 202, a level shift unit 204 and voltage regulator device 206. The current driver 202 comprises a current generator 208 and a first resistor $R_1$. In the embodiment, the current generator 208 is implemented by a transistor $Q_1$. The current generator 208 is coupled to the first resistor $R_1$ in series via the first node 210. According to the voltage difference between a control terminal 212 (the base of transistor $Q_1$) and the first node 210 (the emitter of transistor $Q_1$), the transistor $Q_1$ generates a supply current $I_o$ for a load 214. The level shift unit 204 is coupled between the first node 210 and the second node 216 to generate a rated voltage difference therebetween. The voltage level of the first node 210 is lower than that of the second node 216. In the embodiment, a TLV431 regulator $IC_1$ is implemented as the voltage regulator device 206. The reference input terminal and the cathode of the TLV431 regulator $IC_1$ are the input terminal and the output terminal of the voltage regulator device 206, respectively. The voltage regulator device 206 may be implemented by other chips such as TS 431(ST), LMV431(NS), RC431A (Fairchild), APL431L(ANPEC), AT431(Aimtron), CAT431L(Catalyst) and others.

The reference terminal and the cathode of the TLV431 regulator $IC_1$ are coupled to the second node 216 and the control terminal 212, respectively. If the voltage level of the second node 216 deviates from a first voltage level $V_{ref}$, the TLV431 regulator $IC_1$ adjusts the voltage level of the control terminal 212 to change the supply current $I_o$. The voltage level of the first node 210 varies with the supply current $I_o$. The control loop can maintain the voltage level of the first node at the first voltage level $V_{ref}$, and the supply current $I_o$ is maintained at a constant value. The level shift unit 204 comprises a constant current source $I_G$ and a second resistor $R_2$. The first node 210 is coupled to the second node 216 by the second resistor $R_2$. The magnitude of the constant current source $I_G$ and the second resistor $R_2$ are defined by the user. The constant current $I_G$ flows through the second resistor $R_2$ and generates a constant voltage difference $V_{R2}(I_G)$ across the second resistor $R_2$. When the current supply 200 is in stable, the voltage level of the first node is a constant value of $V_{ref}$-$V_{R2}(I_G)$, and the supply current $I_o$ is constant. When the constant current $I_G$ is 0.94 mA and the second resistor $R_2$ is 1 KOhm, the rated voltage between the second and the first nodes 216 and 210 is 0.94V. When the first voltage level $V_{ref}$ is 1.24V, the voltage level of the first node is 0.3V (1.24V−0.92V). If the supply current $I_o$ is 1 A, the first resistor $R_1$ approximates 0.3 Ohm. The power consumption of the first resistor $R_1$ approximates 0.3 Watt (P=I·V). The power consumption of the first resistor $R_1$ of the current source 200 is much lower than that of the conventional current source 100 (which requires 1.24 W to generate a supply current of 1 A). The novel current source can generate high supply current for high power application. The level shift unit 204 may be implemented by other devices which can maintain the voltage level of the first node 210 at a value lower than the first voltage level $V_{ref}$ and decrease the power consumption of the first resistor $R_1$.

Figure 3:
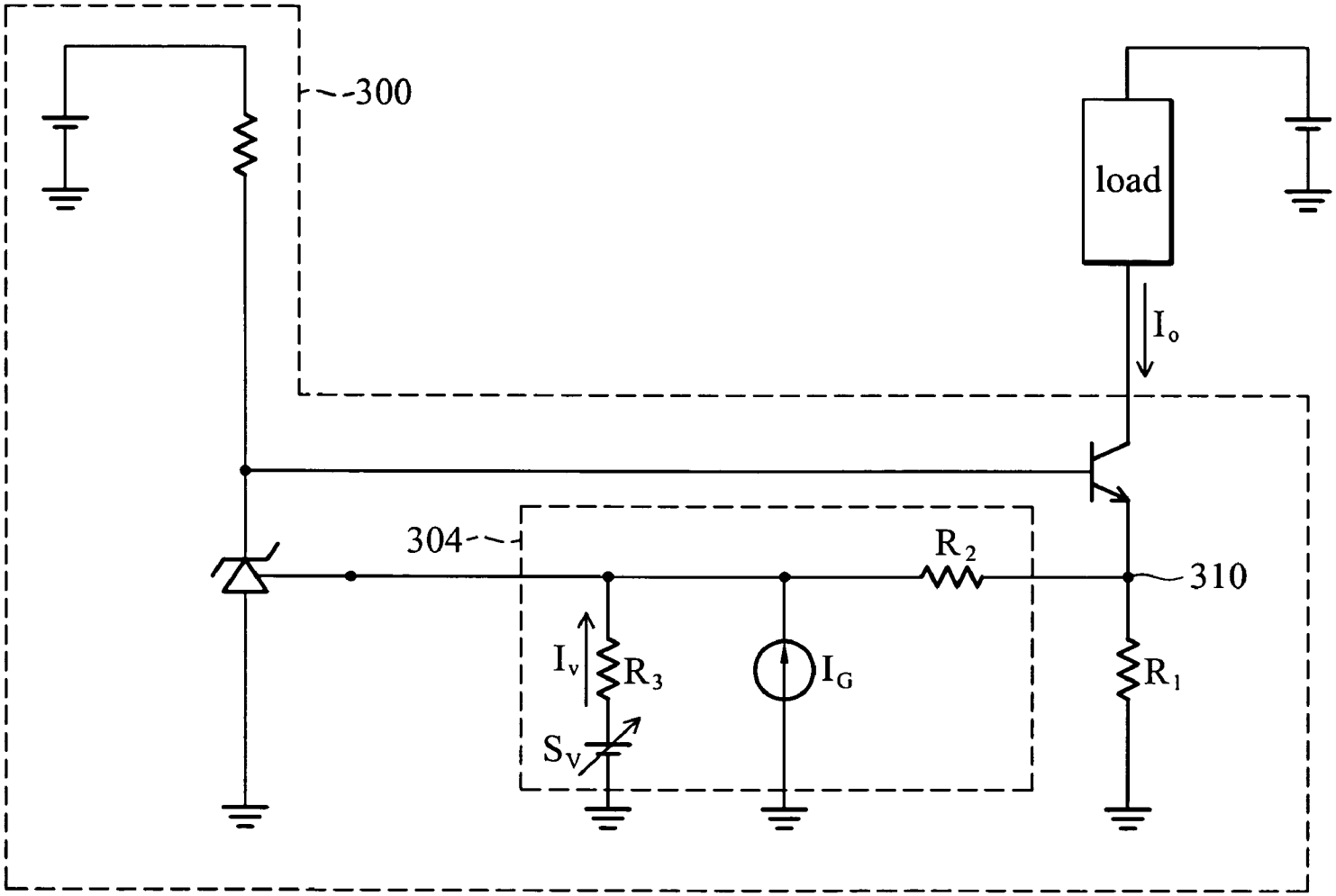
FIG. 3 shows another embodiment of the invention.

FIG. 3 shows another embodiment of the invention. The difference between the current sources 200 and 300 is the level shift unit. In FIG. 3, the level shift unit 304 comprises a second resistor $R_2$, a constant current source $I_G$, a third resistor $R_3$, and a variable voltage source $S_v$. There is a rated voltage difference between the second and the First nodes. The constant $I_G$ flows through the second resistor $R_2$ and generates a constant voltage difference $V_{R2}(I_G)$ across the second resistor $R_2$. The variable voltage source $S_v$ generates a current $I_v$, $(S_v-V_{ref})/R_3$, through the third resistor $R_3$. The current $I_v$ generates a voltage difference $V_{R2}(I_v)$, varying with the output voltage level of the variable voltage source $S_v$, across the second resistor $R_2$. The rated voltage difference between the second and the first nodes is $(V_{R2}(I_G)+V_{R2}(I_v))$. The variable voltage source $S_v$ controls the rated voltage difference to control the voltage level of the first node 310. The voltage level of the first node 310 is $V_{ref}$-$(V_{R2}(I_G)+V_{R2}(I_v))$. When the output voltage of the variable voltage source $S_v$ exceeds the first voltage level $V_{ref}$, $V_{R2}(I_v)$ is positive and the rated voltage difference $(V_{R2}(I_G)+V_{R2}(I_v))$ exceeds $V_{R2}(I_G)$, the voltage level of the first node is lower than $V_{ref}$-$V_{R2}(I_G)$. When the output voltage of the variable voltage source $S_v$ is lower than the first voltage level $V_{ref}$, $V_{R2}(I_v)$ is negative and the rated voltage difference $(V_{R2}(I_G)+V_{R2}(I_v))$ is lower than $V_{R2}(I_G)$, the voltage level of the first node exceeds $V_{ref}$-$V_{R2}(I_G)$. The higher the output voltage of the variable voltage source $S_v$, the lower the voltage level of the first node 310 and the lower the supply current $I_o$. In the embodiment, the voltage level of the first node 310 may exceed the first reference voltage level $V_{ref}$ if the output voltage of the variable voltage source $S_v$ is too small. In such a situation, the third resistor $R_3$ has to be far larger than the second resistor $R_2$ to prevent the voltage level of the first node 310 from exceeding the first reference voltage level $V_{ref}$. In general, we select the third resistor $R_3$ is about 10 times than the second resistor $R_2$.

Figure 4:
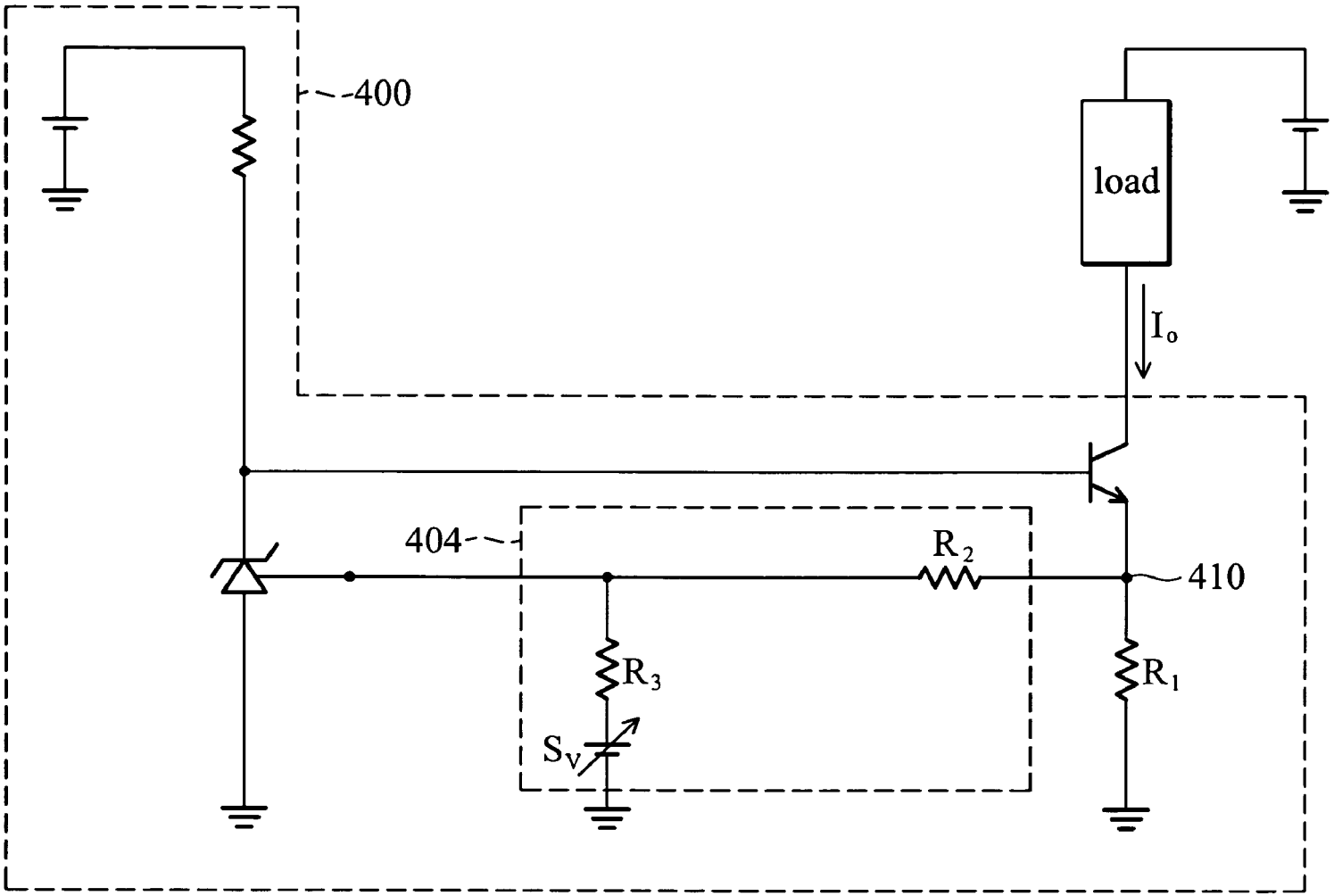
FIG. 4 shows another embodiment of the invention.

FIG. 4 shows another embodiment of the invention. The difference between the current sources 300 and 400 is the level shift unit. In FIG. 4, the level shift unit 404 comprises a second resistor $R_2$, a third resistor $R_3$, and a variable voltage source $S_v$. The current $I_v$ through the third resistor $R_3$ is $(S_v-V_{ref})/R_3$. The current $I_v$ generates a rated voltage difference $V_{R2}(I_v)$ across the third resistor $R_3$. The voltage level of the first node 410 varies with the rated voltage difference $V_{R2}(I_v)$ which varies with the output voltage of the variable voltage source $S_v$. When the output voltage of the variable voltage source $S_v$ exceeds the first voltage level $V_{ref}$, the voltage level of the first node 410 is lower than that of the second node. When the output voltage of the variable voltage source $S_v$ is lower than the first voltage level $V_{ref}$, the voltage level of the first node 410 exceeds that of the second node. The magnitude of the supply current $I_o$ can be controlled by the variable voltage source $S_v$. The supply current $I_o$ decreases with increasing output voltage level of the variable voltage source $S_v$.

Figure 5:
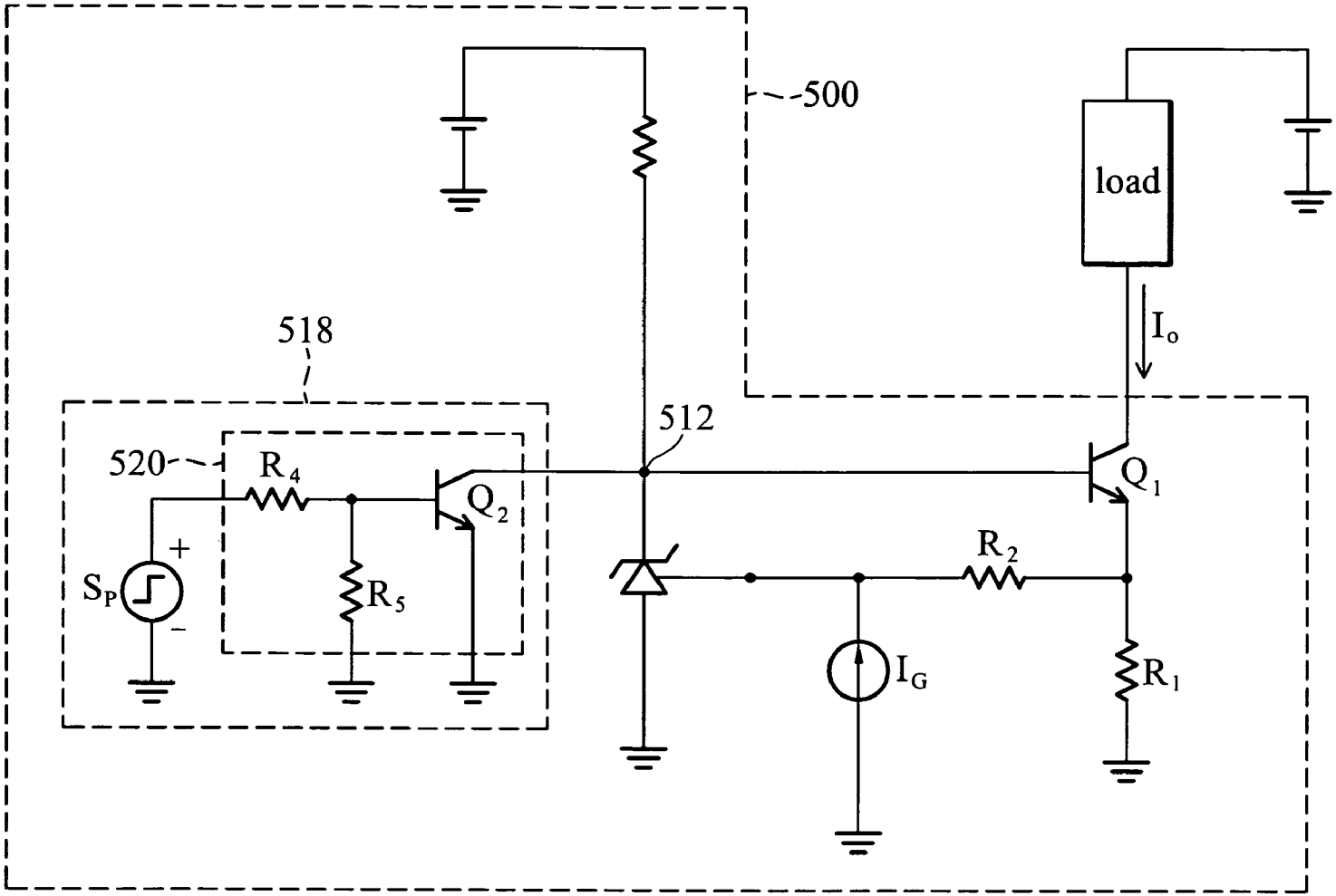
FIG. 5 shows another embodiment of the invention.

FIG. 5 shows another embodiment of the invention. Unlike that shown in FIG. 2, the current source 500 here further comprises a current source switch 518 which is coupled to the control terminal 512. The current source switch 518 can couple the control terminal 512 to a second voltage level (such as ground) to shut down transistor $Q_1$ to stop the supply current $I_o$ and shut down the current source 500. The current source switch 518 can control the supply current $I_o$ to be a pulse wave by intermittently coupling the control terminal 512 to ground. The current source switch 518 comprises a pulse voltage source $S_p$ and a switch 520. The switch 520 comprises a fourth resistor $R_4$, a fifth resistor $R_5$, and a transistor $Q_2$. The fourth resistor $R_4$ is coupled between the output of the pulse voltage source $S_p$ and the base of the transistor $Q_2$. The fifth resistor $R_5$ is coupled between the base and the emitter of the transistor $Q_2$. The collector and the emitter of the transistor $Q_2$ are coupled to the control terminal 512 and ground, respectively. When the output of the pulse voltage source $S_p$ is at a first level (a high voltage level), the transistor $Q_2$ is turned on and the control terminal 512 is coupled to ground via the transistor $Q_2$, and current source 500 is shut down. When the output of the pulse voltage source $S_p$ is at a second level (a low voltage level), the transistor $Q_2$ is turned off. The current source 500 can normally generate the supply current $I_o$. The current source switch 518 can also be introduced to the current sources 300 and 400 to generate supply current in pulse form. Any embodiment of the invention can adopt the current source switch 518. The current sources comprising the current source switch 518 coupled at the control terminal to turn on/off the current source or to generate a supply current in a pulse form are in the scope of the disclosure.

Figure 6:
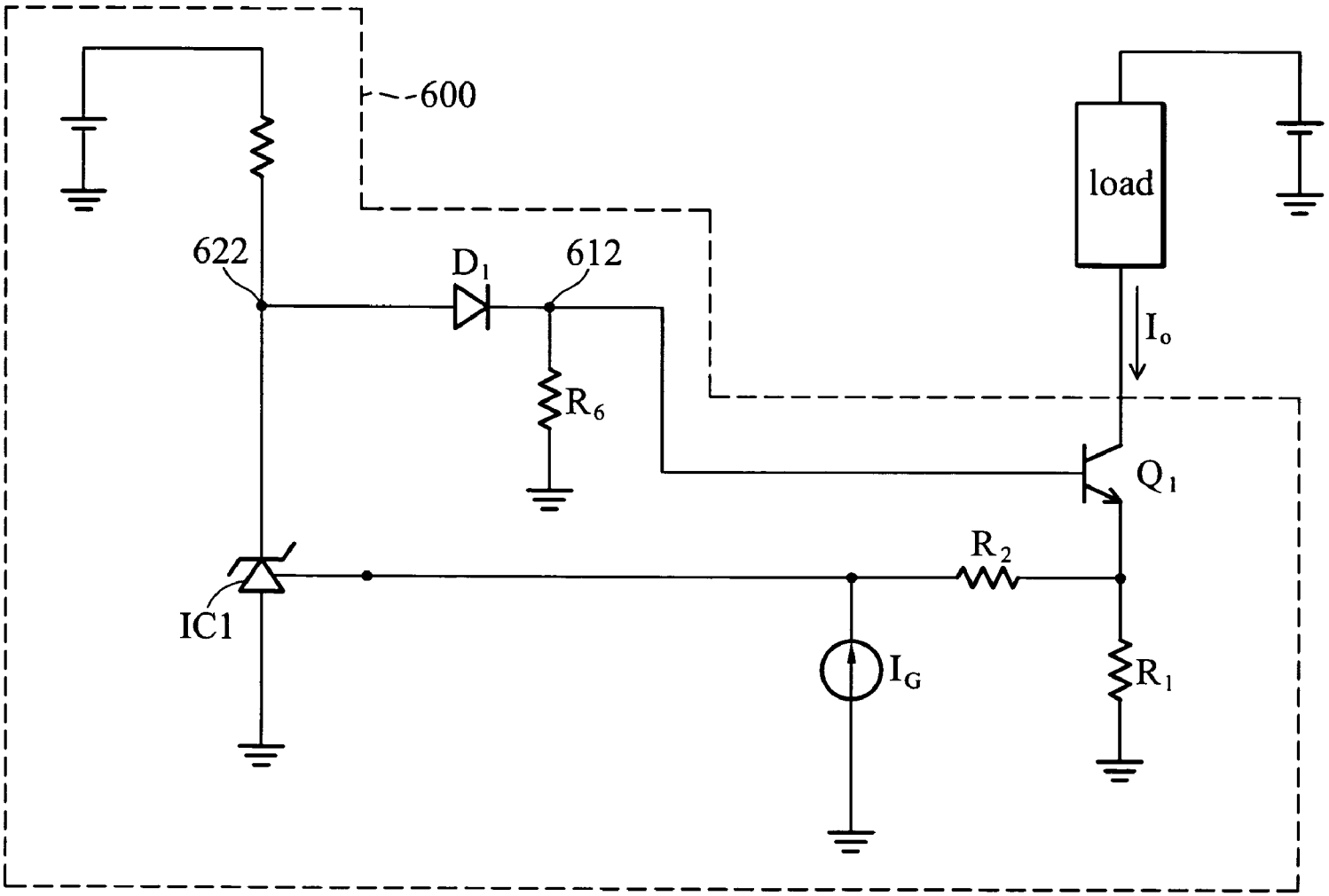
FIG. 6 shows another embodiment of the invention.

The voltage difference between the cathode and the anode of the TLV431 regulator $IC_1$ must exceed a minimum operating voltage to ensure the correct operation of the TLV431 regulator $IC_1$. FIG. 6 shows another embodiment of the invention. Unlike current source 200, the current source 600 here further comprises a diode $D_1$ and a sixth resistor $R_6$. The anode and the cathode of the TLV431 regulator $IC_1$ are coupled to the cathode of the TLV431 regulator $IC_1$ (622) and the control terminal 612, respectively. When the transistor $Q_1$ is conducting, the voltage difference provided by the diode $D_1$, the base-emitter of the transistor $Q_1$ and the first resistor $R_1$ must exceed the minimum operating voltage to ensure the correct operation of the TLV431 regulator $IC_1$. The technique disclosed in FIG. 6 can be applied to other embodiments of the invention to ensure correct operation of the voltage regulator device.

Figure 7:
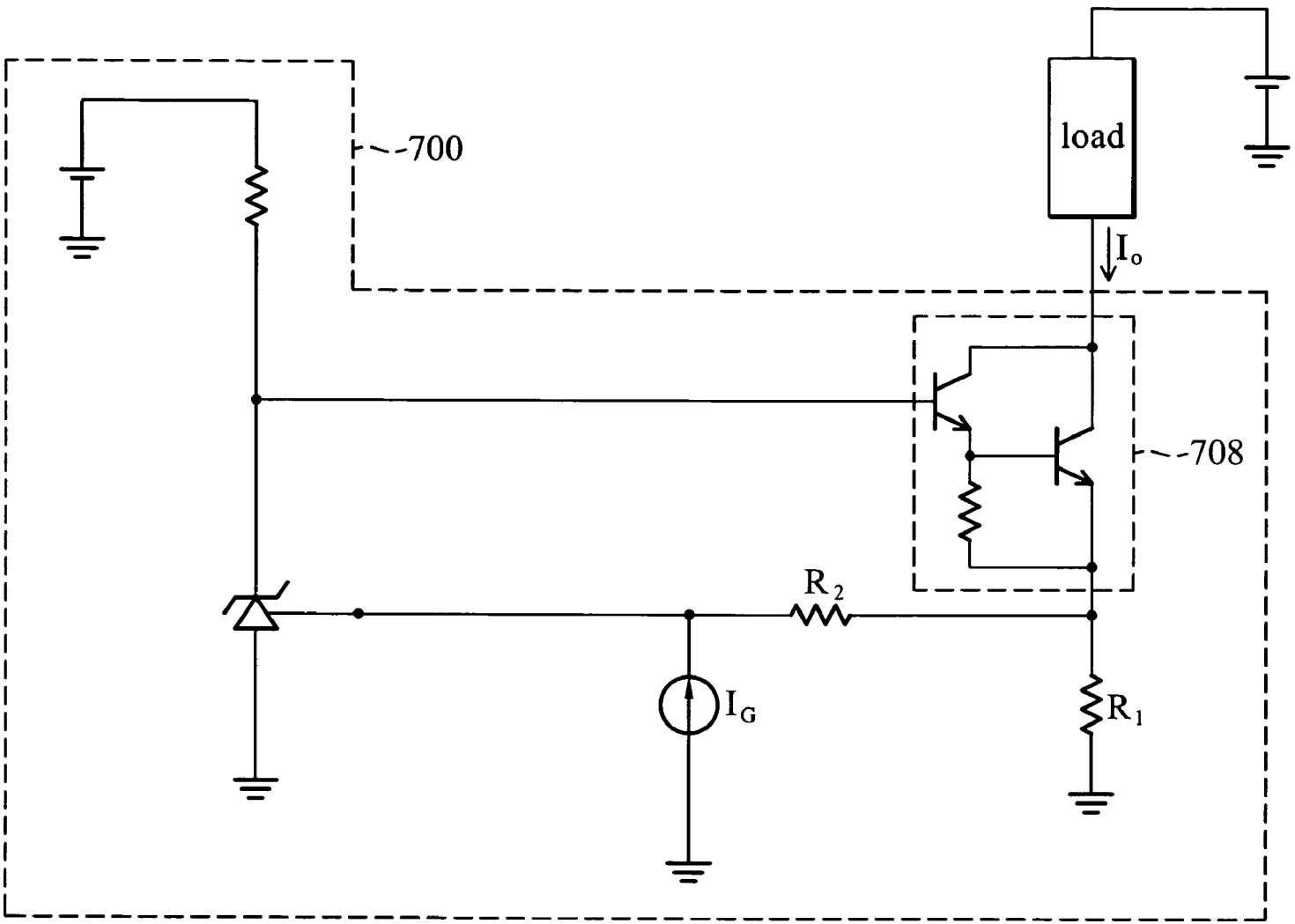
FIG. 7 shows another embodiment of the invention.

FIG. 7 shows another embodiment of the invention. Unlike current source 200, the current generator of the current source 700 is here implemented by a Darlington circuit. The current generator of all embodiments of the invention can be replaced by the Darlington circuit or any circuit having similar function.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded to the broadest interpretation so as to encompass all such modifications and similar arrangements.

What is claimed is:

1. A current source, comprising:

a first node and a second node;

a current driver comprising a current generator and a first resistor, wherein the current generator and the first resistor are serially coupled at the first node, and the current generator has a control terminal and generates a supply current for a load;

a level shift unit coupled between the first and the second nodes to generate a rated voltage difference between the second and the first nodes; and a voltage regulator device having an input terminal and an output terminal respectively coupling to the second node and the control terminal, wherein the voltage level of the control terminal is controlled by the voltage regulator device to maintain the voltage level of the second node at a first voltage reference.

2. The current source as claimed in claim 1, wherein the level shift unit comprises a second resistor coupled between the first and the second nodes and a constant current source through the second resistor to generate a constant voltage difference, wherein the voltage level of the first node is lower than that of the second node.

3. The current source as claimed in claim 2, wherein the level shift unit further comprises a third resistor and a variable voltage source, the third resistor coupled between the variable voltage source and the second node, wherein the rated voltage difference between the second and the first nodes varies with the output of the variable voltage source, and the supply current decreases with increasing output voltage of the variable voltage source.

4. The current source as claimed in claim 3, wherein the rated voltage difference exceeds the constant voltage difference generated by the constant current source when the output voltage of the variable voltage source exceeds the first voltage level.

5. The current source as claimed in claim 3, wherein the rated voltage difference is lower than the constant voltage difference generated by the constant current source when the output voltage of the variable voltage source is lower than the first voltage level.

6. The current source as claimed in claim 5, wherein the value of the third resistor exceeds the value of the second resistor.

7. The current source as claimed in claim 1, wherein the voltage regulator device comprises a regulator chip, the reference input terminal and cathode of which are coupled to the second node and the control terminal, respectively.

8. The current source as claimed in claim 1, wherein the level shift unit comprises a second resistor coupled between the second and the first nodes, a variable voltage source, and a third resistor coupled between the variable voltage source and the second resistor, wherein the rated voltage difference varies with the output voltage of the variable voltage source, and the supply current decreases with increasing output voltage of the variable voltage source.

9. The current source as claimed in claim 8, wherein the voltage level of the first node is lower than that of the second node when the output voltage of the variable voltage source exceeds the first voltage level.

10. The current source as claimed in claim 8, wherein the voltage level of the first node exceeds that of the second node when the output voltage of the variable voltage source is lower than the first voltage level.

11. The current source as claimed in claim 1 further comprises a current source switch coupled to the control terminal, wherein the current source switch can shut down the current source by coupling the control terminal to a second voltage level.

12. The current source as claimed in claim 11, wherein the current source switch can intermittently couple the control terminal to the second voltage level, and the supply current is in pulse form.

13. The current source as claimed in claim 12, wherein the current source switch comprises a pulse voltage source and a switch, wherein the switch couples the control terminal to the second voltage level to shut down the current source when the output of the pulse voltage source is at a first level, and the switch stops coupling the control terminal to the second voltage level and the current source generates the supply current normally when the output of the pulse voltage source is at a second level.

14. The current source as claimed in claim 13, wherein the switch further comprises a transistor, a fourth resistor coupled between the pulse voltage source and the base of the transistor, and a fifth resistor coupled between the base and the emitter of the transistor, wherein the collector and the emitter of the transistor are coupled to the control terminal and the second voltage level, respectively.

15. The current source as claimed in claim 1 further comprising at least one diode and a sixth resistor coupled between the cathode of the diode and ground, the anode and the cathode of the diode coupled to the output terminal of the voltage regulator device and the control terminal, wherein the voltage difference provided by the diode ensures the voltage regulator device works normally.

16. The current source as claimed in claim 1, wherein the current generator is implemented by a transistor.

17. The current source as claimed in claim 1, wherein the current generator is implemented by a Darlington circuit.

* * * * *